United States Patent [19]

Junek et al.

[11] 3,952,494

[45] Apr. 27, 1976

[54] OPEN-END SPINNING UNIT WITH A SPINNING ROTOR

[75] Inventors: Jan Junek; Josef Ripka, both of Usti nad Orlici; Václav Voborník, Letohrad; František Hortlik; František Jaros, both of Usti nad Orlici; Jiri Eliaš, Brandys nad Orlici; Václav Brynda; Karel Mareš, both of Usti nad Orlici; Zdeněk Kotrba; Ludmila Lihtarová, both of Usti nad Orlici; Marie Brožková; Božena Reháckova, both of Usti nad Orlici, all of Czechoslovakia

[73] Assignee: Vyzkumny ustav bavlnarsky, Usti nad Orlici, Czechoslovakia

[22] Filed: Oct. 22, 1974

[21] Appl. No.: 516,885

[30] Foreign Application Priority Data

Oct. 24, 1973 Czechoslovakia ..... 7303-73

[52] U.S. Cl. ..... 57/58.89; 57/58.95

[51] Int. Cl.[2] ..... D01H 1/12

[58] Field of Search ..... 57/58.89–58.95

[56] References Cited

UNITED STATES PATENTS

| | | | |
|---|---|---|---|
| 3,339,359 | 9/1967 | Ripka et al. | 57/58.89 |
| 3,357,168 | 12/1967 | Zlevor et al. | 57/58.89 |
| 3,360,917 | 1/1968 | Kubovy et al. | 57/58.95 |
| 3,557,542 | 1/1971 | Oskin et al. | 57/58.89 |
| 3,620,002 | 11/1971 | Grishin | 57/58.89 |
| 3,698,175 | 10/1972 | Dykast | 57/58.89 |
| 3,798,886 | 3/1974 | Rajnoha et al. | 57/58.89 X |

*Primary Examiner*—John Petrakes

[57] ABSTRACT

Open-end spinning unit with a spinning rotor having a lower side and an upper side. A lid is inserted into a front opening provided in said lower side, said lid being bored so as to form a fiber supply duct to convey separated fibers into the interior of said spinning rotor. A yarn take-off duct extends through said upper side of the spinning rotor and conveys the yarn via an outlet port out of the interior of the spinning rotor. A separator is secured to said lid and is designed to divide the rotor interior into a fiber supply zone and a yarn producing and take-off zone. The front surface of said separator which faces said yarn take-off duct constitutes a directing wall for directing the yarn end being returned to be spun-in, the circumferential edge of said directing wall being located in a space defined by a pair of planes perpendicular to the spinning rotor axis, one of said planes passing through the maximum yarn producing and take-off zone diameter and the other plane being spaced 6 mm therefrom in the direction toward the yarn take-off duct.

16 Claims, 10 Drawing Figures

OPEN-END SPINNING UNIT WITH A SPINNING ROTOR

The present invention relates to an open-end spinning unit with a spinning rotor adapted to receive in its front opening a stationary lid. The lid is bored so as to form a duct discharge into the spinning rotor, said duct being designed to supply separated fibers into the spinning rotor where they are directed onto a slide wall and from there onto the collecting surface to form a fibrous ribbon thereon. The ribbon is twisted to yarn form, which yarn is then withdrawn from the spinning rotor through a yarn take-off duct discharging from the interior of the spinning rotor through an outlet port.

As is known, there exist spinning units in which the yarn take-off also extends through the lid received in the spinning rotor so the yarn is taken off in counterflow relative to the fibers supply. In a well-known spinning unit construction the lid is provided with a peripheral groove into which the fibers supply duct discharges, while a lateral wall of said groove opposite the supply duct divides the spinning rotor interior into a fiber supply zone and a yarn take-off zone, the yarn being withdrawn through the take-off duct entering the front wall of the lid. In another well-known construction operating upon the counterflow principle, the fiber supply zone is separated from the yarn take-off zone by a flange of the take-off duct which in this case also passes through the lid.

With these constructions operating upon the counterflow principle, the course of the yarn being taken off, as a rule, is broken downstream of the outlet port; this results in an increased friction and consequently in an increased yarn stress which is particularly observed in the operation of high-speed spinning rotors. In view of high speeds of such rotors, the yarn formed on the collecting surface is exposed to a higher centrifugal force so that the stress upon the yarn taken off rises.

On the other hand, there are known spinning units operating upon a co-current material flow principle, wherein at the one side of the spinning rotor there is disposed the lid with the fibers supply duct while at the opposite side thereof the yarn take-off duct discharges from the spinning rotor. This system operating upon the co-current material flow principle is more suitable for use with high-speed spinning rotors, since the trajectory of the yarn is not, as a rule, broken downstream of the outlet port. Apart from this, since in the lid there is provided only one duct, i.e. the fiber supply duct, the diameter of the lid as well as of the spinning rotor proper can be made smaller.

Thus to enhance output of the open-end spinning units by increasing the speed of the spinning rotor, it would be most convenient to use a spinning rotor having relatively small dimensions and operating upon the co-current principle. The practical use of such spinning rotors, however, is prevented by the fact that, due to minimizing the rotor dimensions, the fiber supply zone and the yarn take-off zone would approach each other so as to make the fibers supplied fly and adhere to the yarn, whereby the stability of the spinning process would be endangered and the yarn quality impaired.

Apart from this, any decrease of the inner spinning rotor dimensions would produce difficulties in the spinning-in or piecing process to be carried out in starting the spinning unit in such manner that the yarn end is reintroduced back into the take-off duct up to the collecting surface of the rotating rotor, either due to a sub-atmospheric pressure prevailing in the spinning rotor, or by an injection effect of a pressure air source. The yarn during its backward movement is to follow a very complicated trajectory, having to contact by its end various surfaces, both stationary and rotating, so that this movement of the yarn end takes place quite at random and is uncontrollable. Consequently, the result of spinning-in operation may be poor, or the operation fails altogether. Sometimes the yarn end or the curved yarn end portion returned to the interior of the spinning rotor moves in opposite direction relative to the normal movement of the yarn which latter, as a rule, outruns the spinning rotor rotation. In a spinning rotor having extremely small dimension, the yarn end may even get beyond the plane of the collecting surface.

The object of the present invention is to produce a high-quality yarn and to improve the spinning-in operation in small-dimension spinning rotors with co-current material flow, and to attain in this way an output increase with an open-end spinning machine simultaneously with the production of excellent yarn.

In order to eliminate or at least mitigate the drawbacks of the prior art, the invention provides an open-end spinning unit comprising a spinning rotor into which at the one side thereof a lid with a fiber supply duct is inserted into the front opening of the spinning rotor, and from which at the opposite side a yarn take-off duct discharges through the outlet port thereof, the open-end spinning unit, according to the invention, being characterized in that it comprises a separator secured to said lid and designed to divide the rotor interior into a fiber supply zone and a yarn producing take-off zone, the front surface of said separator, which faces said yarn take-off duct, constituting a directing wall for directing the yarn end being returned to be spun-in, the circumferential edge of said directing wall being located in a space defined by a pair of planes perpendicular to the spinning rotor axis, and of said planes passing through the maximum yarn producing and take-off zone diameter and the plane being spaced at a distance no more than 6 mm therefrom in the direction toward the yarn take-off duct.

In this manner, the fiber supply zone is separated from the yarn take-off zone. The separated fibers being supplied and carried by the air stream, which strike the separator wall facing the lid, are directed towards the slide wall, thus being prevented from flying on and adhering to the yarn.

The directing wall, i.e. the separator wall facing the yarn take-off duct, is designed to direct the yarn end to be spun-in whereby the spinning-in operation is improved. In accordance with another feature of the invention, the diameter of the separator does not exceed the diameter of the front opening of the spinning rotor.

According to a preferred embodiment, the directing wall has the configuration of a circular trough having its central point within the rotor axis.

In order effectively to separate the fiber supply zone from the yarn take off zone, the separator occupies from one-tength to one-third of the total inner volume of the spinning rotor, and the thickness of the separator varies within the range of from one-fifth to one-third of the depth of the rotor interior. The separator is spaced from the front surface of the lid at a distance varying between 2 and 4 millimeters.

In a preferred embodiment, the surface of the separator facing the lid is spaced from the plane of the collecting surface at a distance varying between 2 and 5 millimeters.

The invention is further characterized in that the separator has the form of a body of revolution, and is relieved in the form of a circumferential annular recess.

In a well-known embodiment, and more particularly in large-diameter spinning rotors operating upon the counterflow principle, the separator is secured to the lid by means of an axially disposed holder. However, this mode of attachment cannot be applied to the small diameter rotor according to the invention, on the one hand, since the axial location of the holder would prevent the fiber supply duct from discharging substantially axially from the lid, and, on the other hand, since around the holder, the diameter of which in view of the small rotor diameter, has to be also small, the fiber supplied, would pass at a low rate and would be engaged by it, whereby the spinning process would be unfavorably affected.

Therefore, according to the invention, the holder of the separator is secured to the lid eccentrically and is located in an annulus by two circles having the radii $1/13r$ and $r$, respectively, $r$ being the radius of the lid. The cross-sectional areas of the holder and of the lid have a ratio varying between 1 to 3 and 1 to 30.

Due to the fact that in the region of the eccectrically disposed holder the air-borne fibers flow at a higher velocity than adjacent to the rotor axis, the holder is blown over by air and is passed by fibers which latter do not adhere thereto. To attain a desirable air stream condition in the rotor interior, the cross-section of the holder may preferably have the form of a circle, a segment of a circle, or a streamlined configuration.

In order that the invention be better understood and carried into practice, some preferred embodiments thereof will be now described with reference to the accompanying schematic drawings in which.

Figure 1:
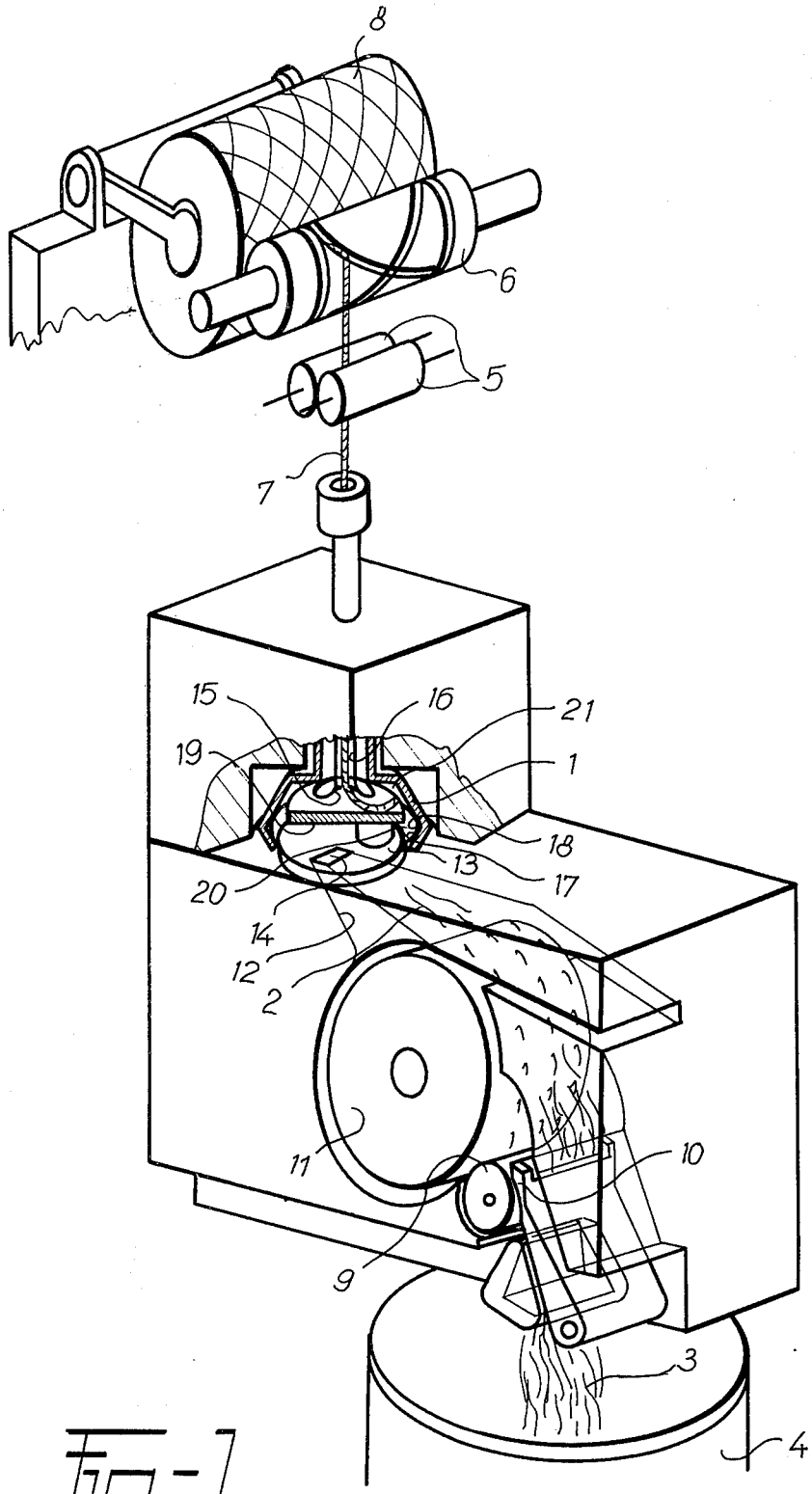
FIG. 1 is a perspective view of the arrangement of the invention.

FIG. 1 shows a spinning unit comprising a spinning rotor 1 below which there is arranged a device for separating fibers out of a sliver 3 received in a can 4. Above the spinning rotor 1 there is provided a pair of yarn take-off rollers 5, and above them there is a distributing cylinder 6 for distributing yarn 7 to be wound onto a bobbin 8.

The fiber separating device consists of a fiber supply roller 9 cooperating with a presser foot 10 and a combing-out cylinder 11 followed by a fiber supply duct 12 for separated fibers 2, which duct extends through a lid 13 received in a front opening 14 of the spinning rotor 1. At the opposite side of the spinning rotor 1 a yarn take-off duct 16 is arranged to discharge through an outlet port 15 from the interior of the spinning rotor 1.

The interior of the spinning rotor 1 has a double frusto-conical shape of which the larger base is common. The lower inner conical wall of the spinning rotor 1 constitutes a slide wall 17 for fibers 2 while in the region of the largest periphery of the spinning rotor 1 there is provided a collecting surface 18 for forming a fibrous ribbon. The interior of the spinning rotor is divided by a separator 19 into a lower or fiber supply zone 20 and an upper or yarn take-off zone 21. Between the lid 13 and the edge of the front opening 14 of the spinning rotor 1 there is provided an air outlet gap.

Figure 3:
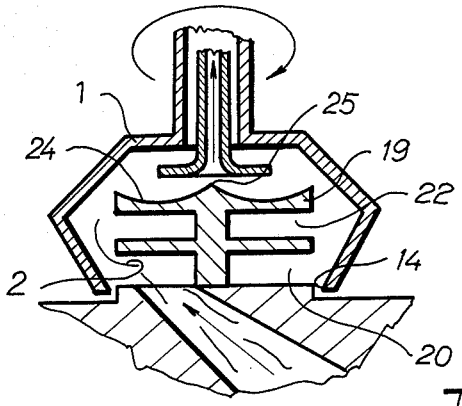

The separator 19 has the form of a body of rotation, the diameter of which does not surpass the diameter of the front opening 14 of the spinning rotor 1. As shown in FIG. 3, the separator 19 is relieved in the form of an annular recess 22. The fiber supply zone 20 is effectively separated from the yarn take-off zone 21 so that the volume of the separator 19 takes from 1/10 to ⅓ of the inner volume of the spinning rotor 1 while its thickness determining the mutual distance between the zones 20 and 21 varies between 1/5 and ⅓ of the depth of the spinning rotor interior. The surface of the separator 19 facing the lid 13 is spaced from the plane of the collecting surface 18 at a distance varying between 2 and 5 mm and from the front surface of the lid 13 at a distance varying between 2 and 4 mm.

The opposite surface of the separator 19 facing the yarn take-off duct 16 is adapted to form a directing wall 23 for directing the yarn 7 when returned to be pieced up. The imaginary plane extending through the circumferential edge of the directing wall 23 is located in a space defined between a pair of planes perpendicular to the spinning rotor axis, one of said planes passes through the maximum yarn producing and take-off zone diameter and the other plane is spaced 6 mm therefrom in the direction toward the yarn take-off duct.

Figure 2:
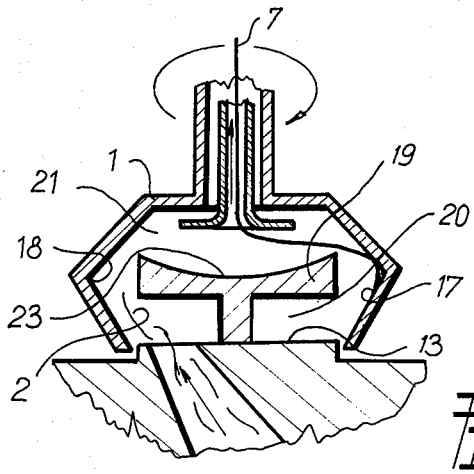
FIGS. 2, 3, 4 and 5 show respectively four exemplary embodiments of the spinning rotor with the lid, all in axial sections.
Figure 4:
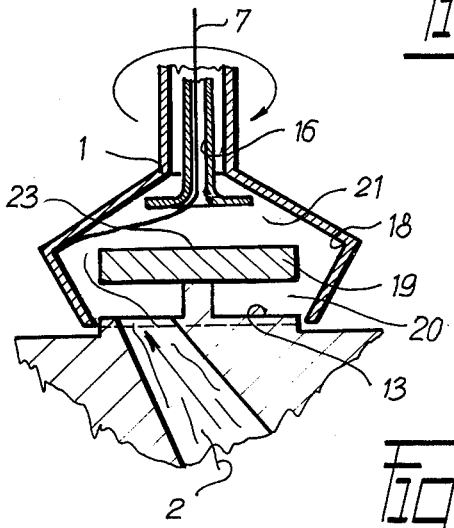
Figure 5:
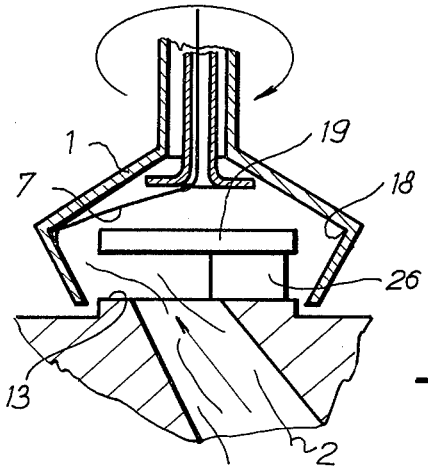

In the embodiments shown in FIGS. 1, 4 and 5, the directing wall 23 is planar; in FIG. 2 it is concave, and in FIG. 3 is has the form of a circular trough 24 with a central point 25 lying within the rotor axis.

As apparent from FIGS. 5 through 10, the separator 19 is affixed to the lid 13 by means of an eccentrically disposed holder 26 located within an annulus which is defined by the circles having the radii 1/13 and $r$, respectively, $r$ being the radius of the lid 13. The ratio between the cross-sectional area of holder 26 and that of the lid 13 varies between ⅓ and 1/30.

Figure 6:
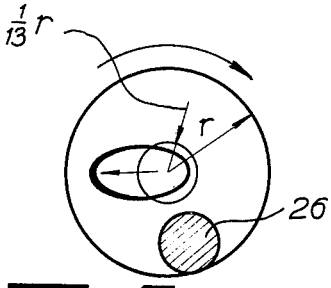
FIGS. 6, 7, 8, 9 and 10 are respectively, five exemplary embodiments of the lid in top view, the holders being shown in cross-section.
Figure 7:
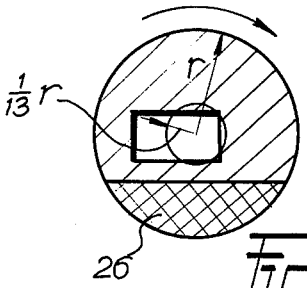
Figure 8:
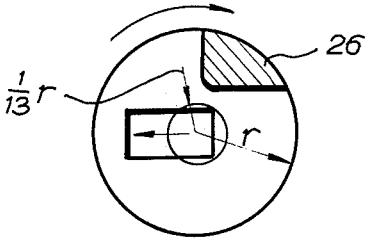
Figure 9:
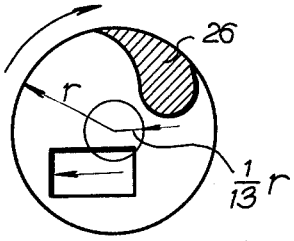
Figure 10:
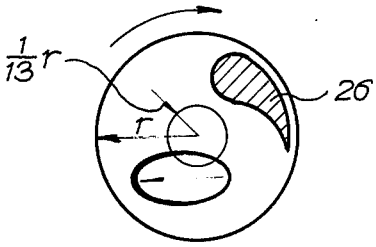

In the embodiment illustrated in FIG. 6, the holder 26 has a circular cross-section; in FIG. 7 it is formed as a segment of circle, in FIG. 8 it is shown as a part of a circle segment, while in FIGS. 9 and 10 its cross-section is of a streamlined configuration.

The open-end spinning unit according to the invention, operates as follows:

Fibers 2 are separated by the combing-out cylinder 11 out of the fibrous sliver 3 withdrawn from the can 4 by the supply roller 9, whereupon they are sucked by an air stream generated by a sub-atmospheric pressure prevailing in the spinning rotor 1, via supply duct 12 into the interior of the rotor 1. A portion of the fibers 2 discharged out from the opening of the supply duct 12 is conveyed, due to inertia and the air stream, directly onto the slide wall 17 whereas the remaining fibers are directed towards the lower wall of the separator 19 and therefrom onto the slide wall 17. Due to centrifugal force, the fibers 2 slide upon said slide wall 17 to the collecting surface 18 to form a fibrous ribbon thereon, which ribbon is then twisted to yarn 7. The yarn 7 is withdrawn by the take-off roller 5 from the spinning rotor 1 through the take-off duct 16 and is finally distributed by the distributing cylinder 6 to form a cross-wound package on the bobbin 8.

After a yarn breakage occurred during the machine operation or by stopping the machine, a piecing-up or spinning-in operation is carried out at the instant of machine restarting. The end of the yarn 7 is reintroduced into the spinning rotor 1 either by the action of the sub-atmospheric pressure in the rotor 1 or by an injecting effect of a super-atmospheric air pressure. Directing wall 23 directs the yarn 7 towards the fibrous ribbon on the collecting surface 18, whereupon the yarn end and said ribbon become fused together and the newly produced yarn 7 is withdrawn from the rotor 1, whereby the normal spinning process in the unit is restarted.

Although the invention is illustrated and described with reference to a plurality of preferred embodiments thereof, it is to be expressly understood that it is in no way limited to the disclosure of such a plurality of embodiments, but is capable of numerous modifications within the scope of the appended claims.

What is claimed is:

1. An open-end spinning unit comprising a spinning rotor having a lower side and an upper side, a lid inserted into a front opening provided in said lower side, said lid being bored so as to form a fiber supply duct to convey separated fibers into the interior of said spinning rotor; a yarn take-off duct extending through said upper side of the spinning rotor and adapted to convey the yarn via an outlet port out of the interior of the spinning rotor; a separator secured to said lid and designed to divide the rotor interior into a fiber zone and a yarn producing and take-off zone, the front surface of said separator, which faces said yarn take-off duct, constituting a directing wall for directing the yarn end being returned to be spun-in, the circumferential edge of said directing wall being located in a space defined by a pair of planes perpendicular to the spinning rotor axis, one of said planes passing through the maximum yarn producing and take-off zone diameter and the other being spaced 6 mm therefrom in the direction toward the yarn take-off duct.

2. Open-end spinning unit as claimed in claim 1, wherein the diameter of the separator does not exceed the diameter of the front opening of the spinning rotor.

3. Open-end spinning rotor as claimed in claim 1, wherein the directing wall is concave.

4. Open-end spinning rotor as claimed in claim 1, wherein the directing wall has the configuration of a circular trough having its central point within the rotor axis.

5. Open-end spinning rotor as claimed in claim 1, wherein the volume of the separator is from one-tenth to one-third of the total inner volume of the spinning rotor.

6. Open-end spinning rotor as claimed in claim 1, wherein the thickness of the separator varies within the range of from one-fifth to one-third of the depth of the rotor interior.

7. Open-end spinning rotor as claimed in claim 1, wherein the separator is spaced from the front surface of the lid at a distance varying between 2 and 4 millimeters.

8. Open-end spinning rotor as claimed in claim 1, wherein the separator has the form of a body of rotation.

9. Open-end spinning rotor as claimed in claim 1, wherein the separator is provided with a circumferential annular recess.

10. Open-end spinning rotor as claimed in claim 1, wherein the surface of the separator facing the lid is spaced from the plane of the collecting surface at a distance varying between 2 and 5 millimeters.

11. Open-end spinning rotor as claimed in claim 1, wherein the separator is secured to the lid eccentrically by means of a holder.

12. Open-end spinning rotor as claimed in claim 11, wherein the holder of the separator is located in an annulus defined by two circles having the radii $1/13r$ and $r$, respectively, $r$ being radius of the lid.

13. Open-end spinning rotor as claimed in claim 1, wherein the cross-sectional areas of the holder and of the lid have a ratio varying between 1 to 3 and 1 to 30.

14. Open-end spinning rotor as claimed in claim 1, wherein the cross-section of the holder is of circular shape.

15. Open-end spinning rotor as claimed in claim 1, wherein the cross-section of the holder has the form of a circle segment.

16. Open-end spinning rotor as claimed in claim 1, wherein the cross-section of the holder is of a streamlined configuration.

* * * * *